US008295722B2

(12) United States Patent
Pino

(10) Patent No.: US 8,295,722 B2
(45) Date of Patent: Oct. 23, 2012

(54) XEROGRAPHIC DEVELOPER

(75) Inventor: Jason Pino, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 244 days.

(21) Appl. No.: 12/710,384

(22) Filed: Feb. 23, 2010

(65) Prior Publication Data

US 2011/0206396 A1 Aug. 25, 2011

(51) Int. Cl.
*G03G 15/00* (2006.01)
*G03G 15/08* (2006.01)

(52) U.S. Cl. ..... 399/49; 399/53

(58) Field of Classification Search ..... 399/49, 399/53

See application file for complete search history.

(56) References Cited

U.S. PATENT DOCUMENTS

| | | | |
|---|---|---|---|
| 7,305,206 | B2 | 12/2007 | Hart et al. |
| 7,333,753 | B2 | 2/2008 | Hart et al. |
| 2009/0022521 | A1 | 1/2009 | Keilty et al. |

FOREIGN PATENT DOCUMENTS

| | | | | |
|---|---|---|---|---|
| JP | 04106556 | A | * | 4/1992 |
| JP | 05289494 | A | * | 11/1993 |
| JP | 06043749 | A | * | 2/1994 |
| JP | 2005316083 | A | * | 11/2005 |
| JP | 2007171223 | A | * | 7/2007 |

OTHER PUBLICATIONS

Aoki et al. (JP 06-043749 A) JPO Machine Translation.*

* cited by examiner

*Primary Examiner* — David Gray
*Assistant Examiner* — Erika J Villaluna

(57) ABSTRACT

There is provided an apparatus for developing a latent image recorded on an imaging surface, including: a housing defining a reservoir storing a supply of developer material comprising toner; a donor member positioned in the housing, spaced from the imaging surface, for transporting toner on an outer surface of the donor member to a region opposed from the imaging surface, a print quality system for monitoring a plurality of xerographic actuator parameters, the print quality system generating a feedback signal if at least one of a plurality of xerographic actuator parameters is beyond a predefined threshold limit; and system for translating the donor member from a first predefined spacing to a second predefined spacing from the imaging surface in response to the feedback signal from the print quality system.

10 Claims, 4 Drawing Sheets

XEROGRAPHIC DEVELOPER

TECHNICAL FIELD

The present disclosure relates generally to an electrostatographic or xerographic printing machine, and more particularly concerns a developability control using dynamic drum to mag roll spacing (drs).

BACKGROUND

In the process of electrophotographic printing, a charge-retentive surface, also known as a photoreceptor, is charged to a substantially uniform potential, so as to sensitize the surface of the photoreceptor. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the latent image. This developed image on the photoreceptor is subsequently transferred to a sheet on which the desired image is to be printed. Finally, the toner on the sheet is heated to permanently fuse the toner image to the sheet.

The approach utilized for multicolor electrophotographic printing is substantially identical to the process described above. However, rather than forming a single latent image on the photoconductive surface in order to reproduce an original document, as in the case of black and white printing, multiple latent images corresponding to color separations are sequentially recorded on the photoconductive surface. Each single color electrostatic latent image is developed with toner of a color corresponding thereto and the process is repeated for differently colored images with the respective toner of corresponding color. Thereafter, each single color toner image can be transferred to the copy sheet in superimposed registration with the prior toner image, creating a multi-layered toner image on the copy sheet. Finally, this multi-layered toner image is permanently affixed to the copy sheet in substantially conventional manner to form a finished copy.

With the increase in use and flexibility of printing machines, especially color printing machines which print with two or more different colored toners, it has become increasingly important to monitor the toner development process so that increased print quality, stability and control requirements can be met and maintained. For example, it is very important for each component color of a multi-color image to be stably formed at the correct toner density because any deviation from the correct toner density may be visible in the final composite image. Additionally, deviations from desired toner densities may also cause visible defects in mono-color images, particularly when such images are half-tone images. Therefore, many methods have been developed to monitor the toner development process to detect present or prevent future image quality problems.

For example, it is known to monitor the developed mass per unit area (DMA) for a toner development process by using densitometers such as infrared densitometers (IRDs) to measure the mass of a toner process control patch formed on an imaging member. IRDs measure total developed mass (i.e., on the imaging member), which is a function of developability and electrostatics. Electrostatic voltages are measured using a sensor such as an ElectroStatic Voltmeter (ESV).

Developability is a measure of the amount of development (toner mass/area) that takes place under a given set of electrostatic conditions. The developability is usually a function of the toner concentration in the developer housing as well as other toner state parameters, such as adhesion. Toner concentration (TC) is measured by directly measuring the percentage of toner in the developer housing (which, as is well known, contains toner and carrier particles).

As indicated above, the development process is typically monitored (and thereby controlled) by measuring the mass of a toner process control patch and by measuring TC in the developer housing. However, the relationship between TC and developability is affected by other variables, such as ambient temperature, humidity and the age of the toner.

SUMMARY

There is provided a system to dynamically control the gap between the magnetic developer roll and the photoconductor. Reduction of variation would be accomplished with a motor-driven mounting system to control the DRS and would provide two benefits. First, it would serve as another actuator for developability, such as TC and development potential, which would increase the latitude of the control system. And second, it could provide a differential gap from inboard to outboard that could be used to compensate for monotonic cross-process variation.

There is provided an apparatus for developing a latent image recorded on an imaging surface, including: a housing defining a reservoir storing a supply of developer material comprising toner; a donor member positioned in the housing, spaced from the imaging surface, for transporting toner on an outer surface of the donor member to a region opposed from the imaging surface, a print quality system for monitoring a plurality of xerographic actuator parameters, the print quality system generating a feedback signal if at least one of a plurality of xerographic actuator parameters is beyond a predefined threshold limit; and system for translating the donor member from a first predefined spacing to a second predefined spacing from the imaging surface in response to the feedback signal from the print quality system.

DETAILED DESCRIPTION

Figure 1:
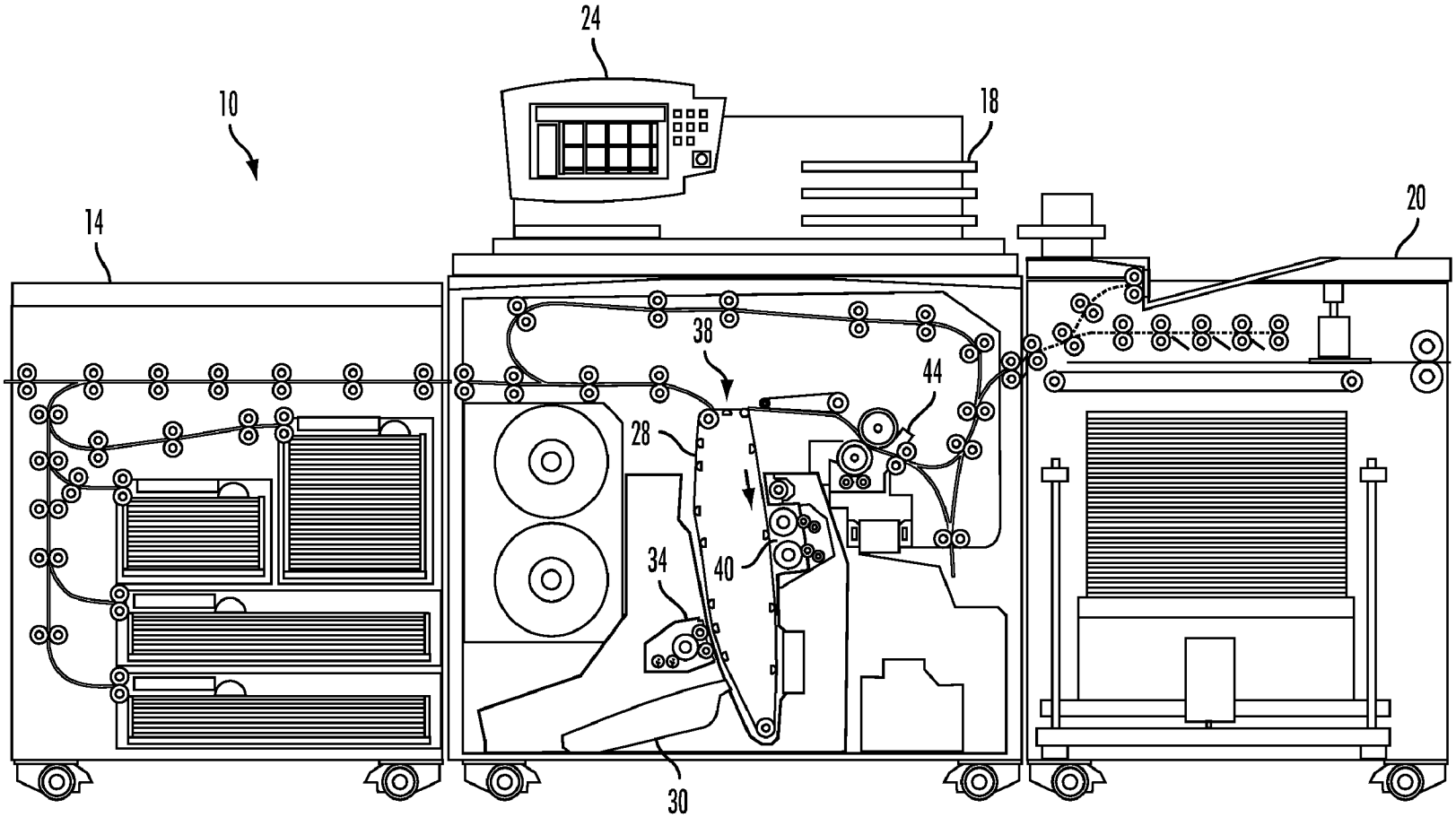
FIG. 1 is an elevational view of an electrostatographic printing apparatus incorporating a semiconductive magnetic brush development (SCMB) system having two magnetic rolls.

FIG. 1 is an elevational view of an electrostatographic printing apparatus 10, such as a printer or copier, having a development subsystem that uses two magnetic rolls for developing toner particles that are carried on semiconductive carrier particles. The machine 10 includes a feeder unit 14, a printing unit 18, and an output unit 20. The feeder unit 14 houses supplies media sheets and substrates onto which document images are transferred by the printing unit 18. Sheets to which images have been fixed are delivered to the output unit 20 for correlating and/or stacking in trays for pickup.

The printing unit 18 includes an operator console 24 where job tickets may be reviewed and/or modified for print jobs performed by the machine 10. The pages to be printed during a print job may be scanned by the printing machine 10 or received over an electrical communication link. The page images are used to generate bit data that are provided to a raster output scanner (ROS) 30 for forming a latent image on the photoreceptor 28. Photoreceptor 28 continuously travels the circuit depicted in the figure in the direction indicated by the arrow. The development subsystem 34 develops toner on the photoreceptor 28. At the transfer station 38, the toner conforming to the latent image is transferred to the substrate by electric fields generated by the transfer station. The substrate bearing the toner image travels to the fuser station 44 where the toner image is fixed to the substrate. The substrate is then carried to the output unit 20. This description is provided to generally describe the environment in which a double magnetic roll development system for developer having semiconductive carrier particles may be used and is not intended to limit the use of such a development subsystem to this particular printing machine environment.

Figure 2:
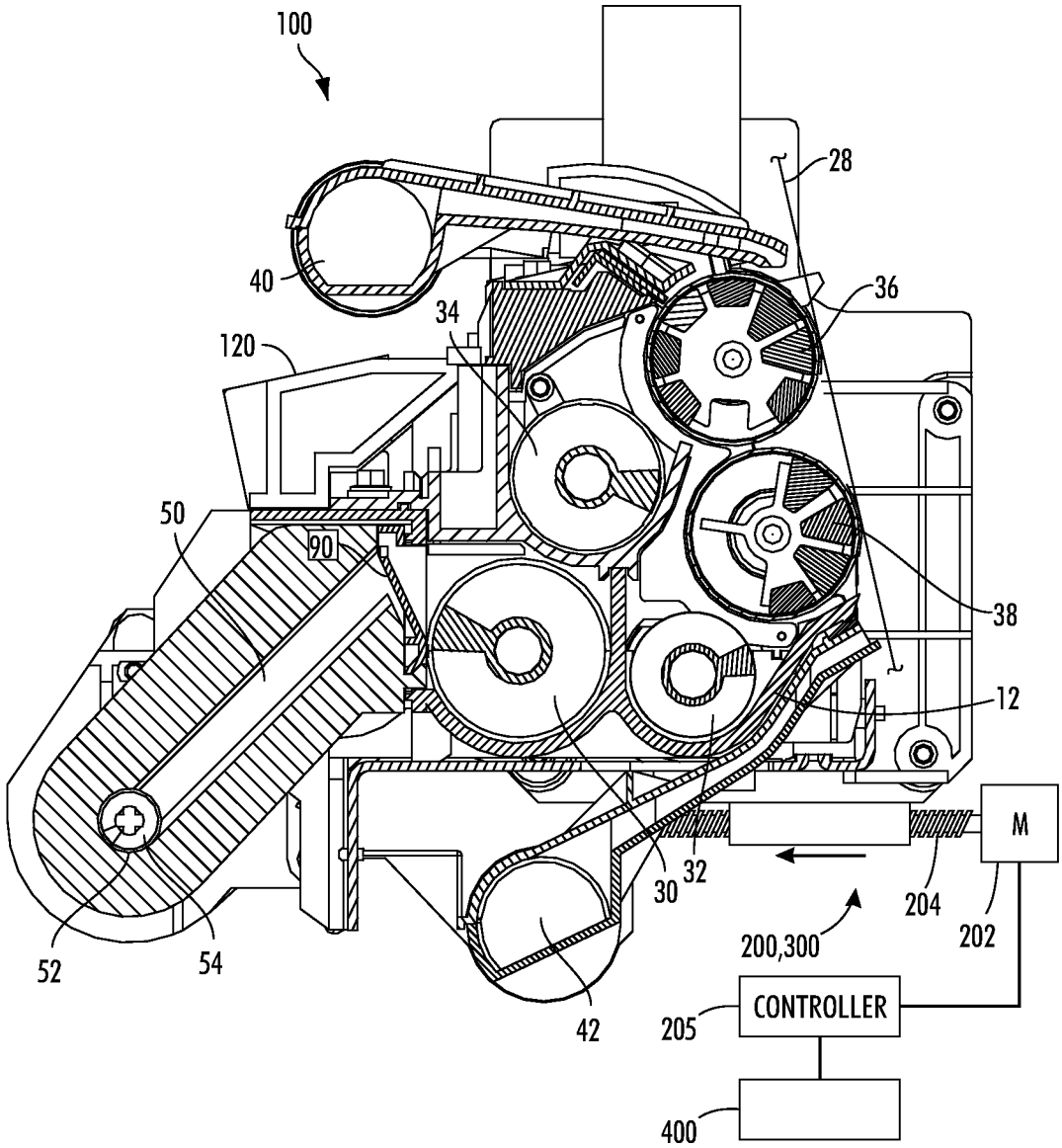
FIG. 2 is a sectional view of a SCMB developer unit having two magnetic rolls.

The overall function of developer unit 100, which is shown in FIG. 2, is to apply marking material, such as toner, onto suitably-charged areas forming a latent image on an image receptor such as the photoreceptor 28, in a manner generally known in the art. The developer unit 100, however, provides a longer development zone while maintaining an adequate supply of developer having semiconductive carrier particles than development systems previously known. In various types of printers, there may be multiple such developer units 100, such as one for each primary color or other purpose.

Among the elements of the developer unit 100, which is shown in FIG. 2, are a housing 120, which functions generally to hold a supply of developer material having semiconductive carrier particles, as well as augers, such as 30, 32, and 34, which variously mix and convey the developer material to the magnetic rolls 36 and 38, which in this embodiment form magnetic brushes to apply developer material to the photoreceptor 28. Other types of features for development of latent images, such as donor rolls, paddles, scavengeless-development electrodes, commutators, etc., are known in the art and may be used in conjunction with various embodiments pursuant to the claims. In the illustrated embodiment, there is further provided air manifolds 40, 42, attached to vacuum sources (not shown) for removing dirt and excess particles from the transfer zone near photoreceptor 28. As mentioned above, a two-component developer material is comprised of toner and carrier. The carrier particles in a two-component developer are generally not applied to the photoreceptor 28, but rather remain circulating within the housing 12. The augers 30, 32, and 34 are configured and cooperate in a manner described in U.S. Pat. Nos. 7,305,206 and 7,333,753, both of which are hereby expressly incorporated herein in their entireties by reference and are commonly assigned to the assignee of this patent application.

Figure 3:
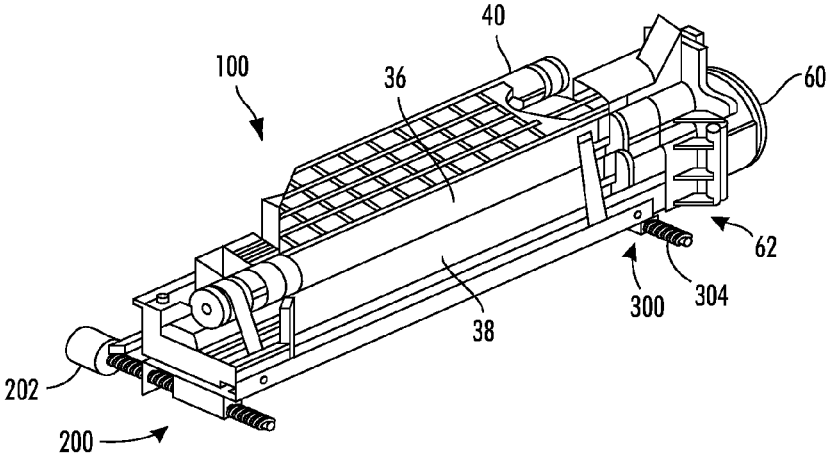
FIG. 3 is a perspective view of a SCMB developer unit having two magnetic rolls.

FIG. 3 is a perspective view of a portion of developer unit 100. As can be seen in this embodiment, the upper magnetic roll 36 and the lower magnetic roll 38 form a development zone that is approximately as long as the two diameters of the magnetic rolls 36 and 38. As can be further seen, a motor 60 is used with a mechanism, generally indicated with reference numeral 62, to cause rotation of the various augers, magnetic rolls, and any other rotatable members within the developer unit 100 at various relative velocities. There may be provided any number of such motors. The magnetic rolls 36 and 38 are rotated in a direction that is opposite to the direction in which the photoreceptor moves past the developer unit 100. That is, the two magnetic rolls are operated in the against mode for development of toner. In one embodiment of the developer unit 100, the motor 60 and the mechanism 62 cause the magnetic rolls to rotate at a speed in the range of about 1 to about 1.5 times the rotational speed of the photoreceptor 28. This rotational speed is lower than the rotational speed of magnetic rolls in developer systems that rotate in the same direction as the photoreceptor. That is, the magnetic rolls operated in the against mode may be rotated at lower speeds than magnetic rolls operated in the with mode. These slower speeds increase the life of the magnetic rolls over the life of magnetic rolls that are operated in the with mode to develop toner carried on semiconductive carrier particles.

Figure 4:
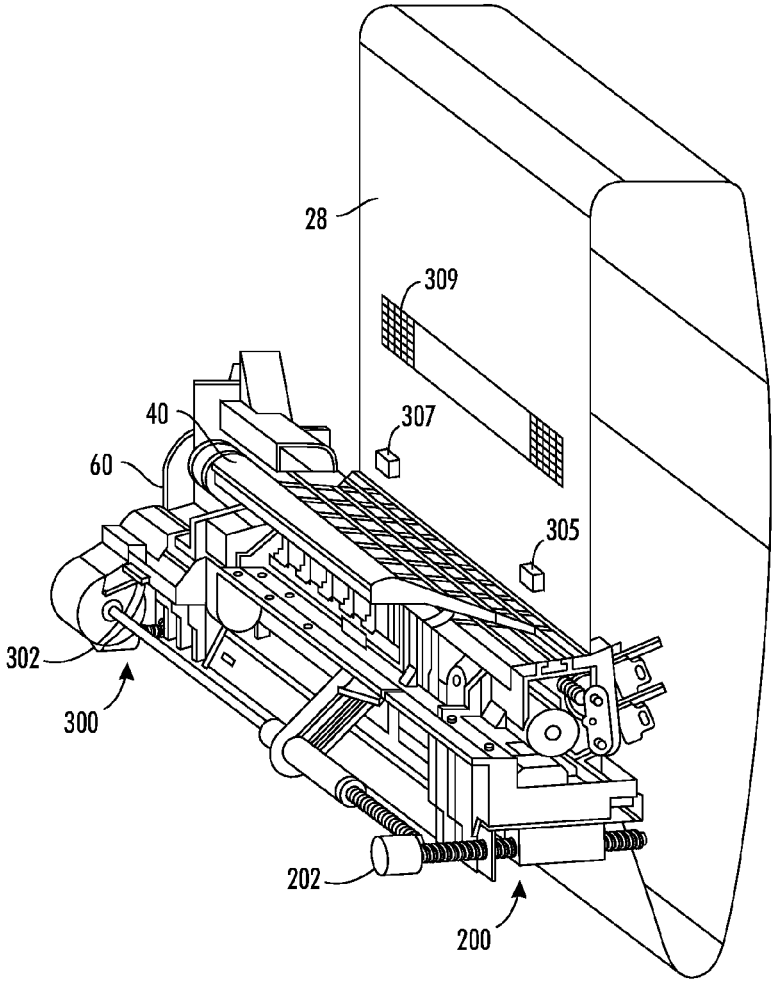
FIG. 4 is a perspective view of a SCMB developer unit showing the relationship of the two magnetic rolls to the path of the photoreceptor bearing a latent image.

FIG. 4 shows the relationship of the photoreceptor 28 to the developer unit 100 within a printing machine, such as the machine 10 shown in FIG. 1. In this arrangement, the lower magnetic roll 38 develops approximately 70% of the toner that is developed in the development zone of the developer unit 100 and the upper magnetic roll 36 develops approximately 30% of the toner. The upper roll 36 also cleans up the carrier particles from the development zone. The two magnetic roll arrangement operating in the against mode is able to develop toner carried by semiconductive carrier particles while maintaining fine line and edge development at speeds from 100 to over 200 ppm.

As is well known, magnetic rolls, such as magnetic rolls 36 and 38, are comprised of a rotating sleeve and a stationary core in which magnets are housed. In order to provide a surface that impedes the slippage of carrier particles as the outer sleeve rotates, the outer surface of the rotating sleeve may be sand-blasted or grooved. The trim gap is the distance between the trim blade and the upper magnetic roll 36. The trim blade assists in the removal of excess developer from the upper magnetic roll 38 before it is carried into the development zone.

Referring to FIGS. 2-4, translating system translates developer unit 100 in relation to imaging surface 28 thereby changing the drum to roll spacing (DRS). Translating system includes cam screw adjuster 200 and 300 positioned on the inboard and outboard sides of developer unit 100. Cam screw adjuster 200 include servo motor 202 which rotates lead screw 204. Cam screw adjuster 300 include servo motor 302 which rotates lead screw and 304. Servo motors 202 and 302 are independently controlled by translation controller 205 which allows inboard and outboard adjustment of drum to roll spacing (DRS).

Translation controller 205 is responsive to a print quality system 400. Print quality system 400 monitors the printed output. The output, i.e., color copies, printed document, or the like, are expected to have a desired value. The values may include marking particle adherence, color uniformity, color accuracy, or any other image quality attribute. In controlling the quality of the output, a process controller, including sensing or measurement devices and actuation devices, manipulates variables in an attempt to achieve acceptable output quality. The actuators may be voltages, motor speeds, rate at which toner is dispensed, and like adjustments that may be made within the machine. The controller may take an input of the measurements and may provide the new settings for the actuators. For example, voltages in the machine, speed of motors of the machine, or the like, may be adjusted to achieve a better quality output or optimum output. The machine variables are thus adjusted to achieve a customer desired image quality.

The variables of the machine may be adjusted by taking measurements in the machine to determine how well the machine is performing, and then based on those measurements; actuators may be adjusted so that a measured performance equals the customer-desired performance. A controller controls the adjustment mechanism. The controller may be a set of algorithms that take as input the measurement readings. The algorithms may provide an output of new settings for the actuators. This process may occur in real time and may occur repeatedly.

Having in mind the principle components of the present invention better understanding thereof can be had by an example of the present invention operation. Print quality system 400 monitors a plurality of actuator for example print quality system monitors the developed mass per unit area (DMA) for a toner development process by using densitometers 305 and 307 such as infrared densitometers (IRDS) to measure the mass of a toner process control patch 309 formed on an imaging member. To adjust for inboard and outboard print variability toner process control patches are formed on inboard and outboard positions on the imaging member if the measure value sensed by densitometer 305 or densitometer 307. If the sense value is beyond a predefined threshold limit a feedback signal is generated by print quality system 400 to adjust DRS via translation controller 200 of the inboard side 200 or outboard side 300 of the developer unit to obtain the desired output image quality. The typically DRS spaced between 0.1 mm and 0.5 mm. Applicant has found it is preferred to translate the DRS in increments of 0.02 mm between 0.1 mm and 0.5 mm in a control loop process to determining optimum DRS.

In another example print quality system 400 monitors toner concentration in the developer housing a feedback signal is generated if the measured TC is beyond a predefined TC threshold level. Print quality system 400 adjust DRS via translation controller 200 to obtain the desired output image quality.

In another example print quality system monitors the development voltage potential and generates a feedback signal if the monitor development voltage potential is beyond a predefined development voltage potential threshold level in which print quality system 400 to adjust DRS via translation controller 200.

While only a few actuators are discussed above, those ordinarily skilled in the art would understand that many other actuators could be used with embodiments herein and the term "actuators" as used herein includes all such meanings.

Figure 5:
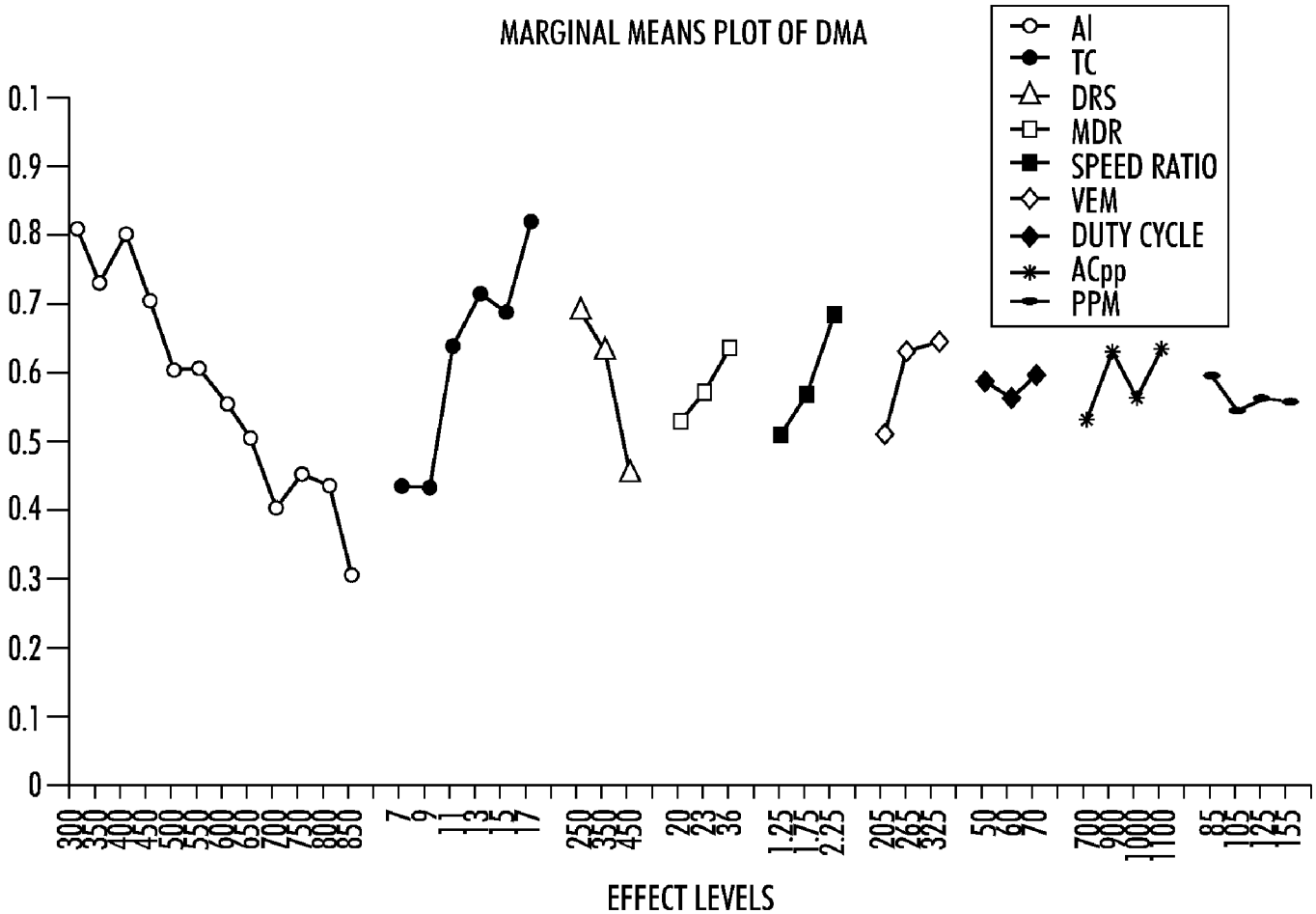
FIG. 5 is data illustrating adjusting DRS gap versus Developed Mass Area (DMA) sensitivity under different actuators.

FIG. 5 is data illustrating adjusting DRS gap versus Developed Mass/Area (DMA) sensitivity under different actuators. The figure shows data collected in a design of experiments. A design of experiments consists of purposeful changes of inputs to a process in order to observe the corresponding changes in the output. Experimental design is a scientific approach which allows the researcher to gain knowledge in order to better understand a process and to determine how the inputs affect the response. In this design of experiments, At, Toner Concentration, Drum to Roll Spacing, Mass on Roll, Speed Ratio Mag Roll/Photo, Mag Bias DC, Mag Bias Duty Cycle, Mag Bias AC, and Machine Process Speed were input factors. The measured response was Developed Mass per unit area (mg/cm^2).

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others.

I claim:

1. An apparatus for developing a latent image recorded on an imaging surface, comprising:

a housing defining a reservoir storing a supply of developer material comprising toner;

a donor member positioned in said housing, spaced from the imaging surface, for transporting toner on an outer surface of said donor member to a region opposed from the imaging surface, a print quality system for monitoring a plurality of xerographic actuator parameters, said print quality system generating a feedback signal if at least one of a plurality of xerographic actuator parameters is beyond a predefined threshold limit; and means for translating said donor member from a first predefined spacing to a second predefined spacing from the imaging surface in response to said feedback signal from said print quality system, said donor member is translated in increments of 0.02 mm.

2. The apparatus of claim 1, wherein said translating means includes a mounting assembly attached to said housing, said mounting assembly being adapted to translate said housing to thereby position said donor member from said first predefined spacing to said second predefined spacing from the imaging surface.

3. The apparatus of claim 1, further comprising a controller, in communication with said print quality system, for controlling the amount of translation of said translating means in responsive to said feedback signal.

4. The apparatus of claim 3, wherein said sensing means senses a first DMA of an inboard portion of said imaging surface and senses a second DMA of an outboard portion of said imaging surface, said sensing means generates inboard feedback signal associated with DMA of said inboard portion of said imaging surface and generates inboard feedback signal associated with DMA of said outboard portion of said imaging surface.

5. The apparatus of claim 4, wherein said mounting assembly is adapted to translate an inboard portion of said donor member independent from an outboard portion of said donor member in response to a control signal from said controller.

6. The apparatus of claim 5, wherein said mounting assembly includes at least one lead screw; and a motor coupled to said lead screw so that rotation of said lead screw moves said donor member from said first predefined spacing to said second predefined spacing from the imaging surface.

7. The apparatus of claim 1, wherein said print quality system includes:

means for recording a test patch on the imaging surface; and means for sensing the DMA of said test patch, said sensing means generating said feedback signal if said measured DMA is beyond a predefined DMA threshold level.

8. The apparatus of claim 1, wherein said print quality system further includes means for determining the toner concentration of said housing, said determining means generating said feedback signal if said measured TC is beyond a predefined TC threshold level.

9. The apparatus of claim 1, wherein said print quality system further includes means for measuring the development voltage potential, said measuring means generating said feedback signal if said measured development voltage potential is beyond a predefined development voltage potential threshold level.

10. The apparatus of claim 1, wherein said donor member and imaging surface are spaced between 0.1 and 0.5 mm.

* * * * *